United States Patent [19]

Schmidt

[11] Patent Number: 4,706,474

[45] Date of Patent: Nov. 17, 1987

[54] PROCESS OF MANUFACTURING A KNITTED PILE FABRIC

[75] Inventor: Walter R. Schmidt, Krems, Austria

[73] Assignee: Karl Eybl Gesellschaft m.b.H., Krems, Austria

[21] Appl. No.: 863,809

[22] Filed: May 12, 1986

Related U.S. Application Data

[63] Continuation of Ser. No. 591,775, Mar. 21, 1984, abandoned, which is a continuation of Ser. No. 308,253, Oct. 5, 1981, abandoned.

[30] Foreign Application Priority Data

Oct. 29, 1980 [AT] Austria ..... 5315/80

[51] Int. Cl.[4] ..... D04B 9/12

[52] U.S. Cl. ..... 66/9 B; 66/38

[58] Field of Search ..... 66/9 R, 9 B, 194

[56] References Cited

U.S. PATENT DOCUMENTS

| | | | |
|---|---|---|---|
| 2,953,002 | 9/1960 | Hill | 66/9 B |
| 3,052,111 | 9/1962 | Howes | 66/9 B |
| 3,226,952 | 1/1966 | Cassady | 66/9 B |
| 3,651,664 | 3/1972 | Collez | 66/9 B |
| 3,685,315 | 8/1972 | DelBerghe | 66/9 B |
| 3,894,407 | 7/1975 | Clingan et al. | 66/9 B |
| 3,973,414 | 8/1976 | Golladay et al. | 66/9 B |
| 4,051,697 | 10/1977 | York | 66/9 B |
| 4,307,586 | 12/1981 | Schmidt | 66/9 B |

FOREIGN PATENT DOCUMENTS

| | | | |
|---|---|---|---|
| 51059 | 5/1982 | European Pat. Off. | 66/9 B |
| 72425 | 2/1983 | European Pat. Off. | 66/194 |
| 3024705 | 1/1982 | Fed. Rep. of Germany | 66/9 B |
| 1104859 | 3/1968 | United Kingdom | 66/194 |

*Primary Examiner*—Wm. Carter Reynolds

*Attorney, Agent, or Firm*—Kurt Kelman

[57] ABSTRACT

A plain or patterned high-pile or sliver-knit fabric is manufactured on a circular knitting machine which has a cylinder carrying latch needles, horizontally movable sinkers and a carding cloth to comb-in pile fibers to the latch needle hooks during knitting of a base fabric before the base threads are fed to the needles. The needles receiving the combed-in pile fibers are raised at the start of combing-in to a level at which the tips of the latches of the raised needles are positioned below the knock-over or knitting edges of the sinkers and the stitches of a previously knitted course of the fabric remain on the latches. The pile fibers are combed-in at this level.

7 Claims, 18 Drawing Figures

PROCESS OF MANUFACTURING A KNITTED PILE FABRIC

Figure 1:
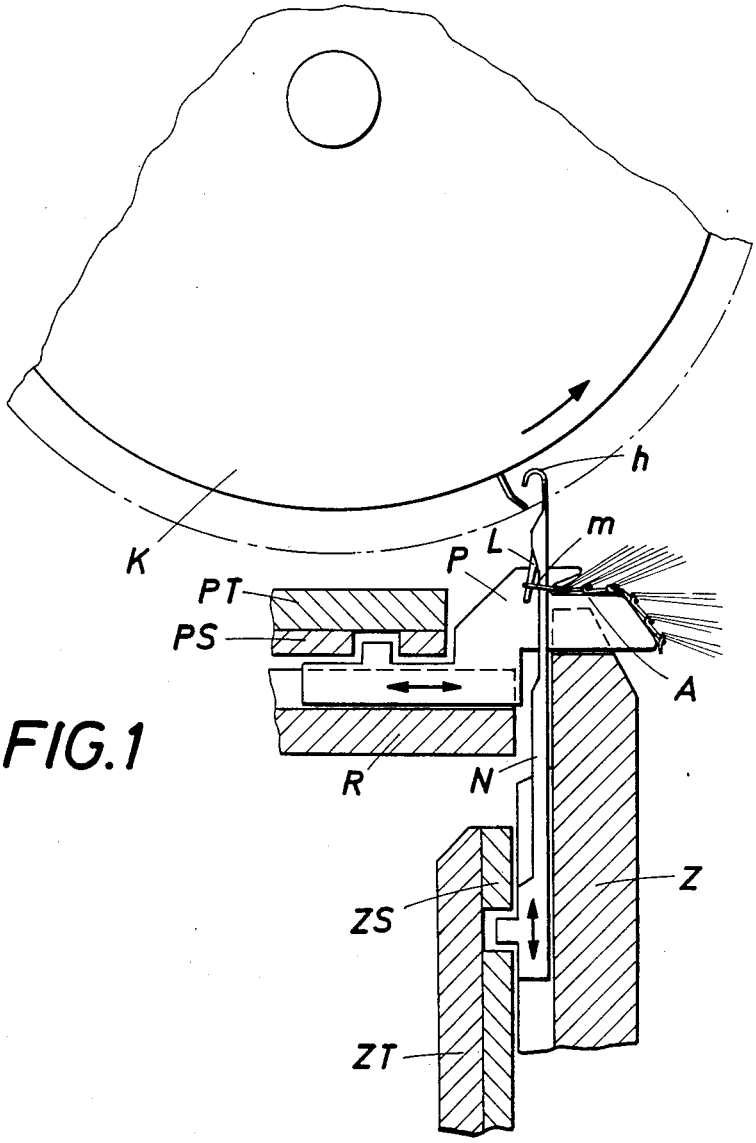

This is a continuation of my copending application Ser. No. 591,775, filed Mar. 21, 1984, now abandoned, which is a continuation of application Ser. No. 308,253, filed Oct. 5, 1981, now abandoned.

This invention relates to a process of manufacturing a plain or patterned knitted pile fabric on a circular knitting machine comprising latch needles which are arranged in the needle cylinder, horizontally movable sinkers and carding means for combing-in the pile fibres, wherein needles are raised for combing-in pile fibres and for knitting a base-fabric, which may be provided with additional threads.

Circular knitting machines for manufacturing pile fabrics are known from U.S. Pat. No. 1,114,414. In such machines, all needles are raised to the clearing position so that the previously knitted stitches are cleared to the needle shanks below the needle latches and the needle-hooks are then travelling on this level in contact with pile fibres presented by a combing-in wheel of a card, which is mounted on the machine and associated with each working system and serves to disintegrate a sliver. In this way the fibrous material enters the needle hooks. Thereafter, a base thread is fed to the needles, the needles are retracted and stitches are knitted from the combed-in pile fibres together with the base thread.

A patterning of such articles is described in U.S. Pat. No. 2,953,022. All needles are raised to the tuck position and a patterning mechanism is used to raise selected needles entirely to the clearing position, whereafter the needle hooks pick up a first fibrous material from a first card. These needles are then also retracted to a feeding position, so that the free ends of the opened needle latches are arranged below the knocking-over edge of the sinkers and the previously knitted stitches are positioned behind the needle latches without closing the latches. The needles at feeding position are arranged in the same level as the needles which previously have been raised only to the tuck position. A second patterning mechanism is now operated to select needles, preferably all or part of those which have previously remained in tuck position, and to raise them to the clearing position. These needles remain in the clearing position until they have picked up a second pile material from a combing-in wheel of a second card. If more than two different pile materials are to be knitted in the subsequent course, the selected needles are retracted to the feeding position again and the above-described needle operations are repeated to take up additional pile materials. When the desired number of pile materials have been combed-in after the last combing-in operation all needles are raised to the clearing position, a base yarn is fed and all needles are retracted to the knock over position to knit stitches (U.S. Pat. No. 4,307,586)

While a patterning in this way reduces the production rate in accordance with the number of the different pile materials which have been knitted in the same course, it has been proposed by U.S. Pat. No. 3,590,604 to separately feed two different slivers per card and to execute the needle selection in such a way as has been described during the travelling of the needles past two cards. Differences in color and pile density result from the proposal of U.S. Pat. No. 4,051,697 where selected needle hooks pick up pile fibres from a portion of the combing-in wheel of the card, preferably over the width of a fibre area, if the card is adapted to feed two different fibre materials.

In addition to the knitting of the fibrous material into stitches together with a base thread it is also possible, in accordance with the U.S. Pat. No. 3,226,952, based on U.S. Pat. No. 3,052,111 to knit the pile material as tuck loops and to anchor the pile fibres by the sinker loops which connect the stitches by the base yarn. The needles are also raised to the clearing position and pile fibres are combed in. Thereafter the needles are retracted as far as possible so that the previously knitted stitches close the needle latches. It is necessary to prevent any stitch from sliding over the needle hooks when no base thread is fed. In this position of the needles air nozzles provided to align the pile material blow the pile fibers to the side so that the pile fibres come beneath the sinker nebs when the previously retracted sinkers are advanced. The sinker nebs must hold down the pile fibers in miss position while the needles are subsequently raised to the clearing position so that the loose pile fibres have to open the needle latches and must then slide below the open latches to clear them. A base thread is immediately fed and the needles are retracted for knitting stitches.

A decisive disadvantage of the previously known circular knitting machines resides in the fact that the needles are raised to the knitting position for combing in the pile fibers. This has particularly undesirable results in U.S. Pat. No. 3,226,952. The pile fibres are combed in in the advanced needle position because owing to the shape of the usually used sinkers the sinker cam plate cannot be arranged below the level of the knocking-over edge of the sinkers. For this reason the arrangement of the sinker cam plate necessitates a corresponding arrangement of the cards and a corresponding needle extension. For this reason, substantially the same needle extension must be provided also in the more recent high-duty machines although it could not be decreased by a reduction of the length of the needle latches. In that case the needles must be raised higher than required for clearing. This is necessary also in the previous processes of manufacturing patterned pile fabrics because the selected needles must be raised to receive the pile fibres in a position which is high enough for the needles which have remained in the tuck or feeding position to prevent any other pile fibres from being combed into the needles which remain in the tuck or feeding position.

Another disadvantage of the previous machines for knitting pile fabrics resides in that the sinker cam plate covers the knocking-over edges of the sinkers and makes viewing of the knitting operation from the front side rather difficult. Owing to the undesirable arrangement of the sinker cap, the air-blowing nozzles for aligning the pile fibres must be arranged on a correspondingly high level so that an insufficient stream of blown air contacts the stitch knitted previously. When the air rate is inadequate and/or nozzles are not properly adjusted, the fibre ends can easily bend outwardly and will be knitted in again. Such defects in the fabric are generally known as air grooves. It does not appear to be possible to produce a fabric according to U.S. Pat. No. 3,226,952 because by raising the needles after combing-in of the pile fibres and before knitting in these fibres, the needle movement will make an opening of the latches impossible.

It is an object of the invention to provide an arrangement in which the needles are raised for combing-in pile fibres only as far as necessary and are further raised for engaging the base thread.

This object is accomplished in the first-mentioned manufacturing process by raising the needles receiving the combed-in pile fibers at the start of the combing-in to a level at which the tips of the latches of the raised needles are positioned below the knock-over or knitting edges of the sinkers and the stitches of a previously knitted course of the fabric remain on the latches, and combing-in the pile fibers at this level.

In preferred embodiments all or selected needles arranged for picking up pile fibres are raised to the tuck position and come in contact with the combing-in wheels. The further raising of the needles to the clearing position and to engage the base thread can be effected during or after the combing-in of the pile fibres. As a result novel fabric structures can be made.

It is an advantage of the invention that all or selected needles must be raised only to the tuck position for combing-in of pile fibres, so that the width of each system is decreased by the lower level of the needles receiving pile fibres whereas the width of the combing-in wheels remain the same so that an additional number of systems may be arranged. Owing to the necessary arrangement of the sinker cam plate on a lower level the knitting operation is visible and can be controlled from the front side. Furthermore, the blown air stream for aligning the pile fibres can be directed straight to the knitting process so that the reverse bending of fibre ends is prevented.

If the needles are positioned in the tuck position during the combing-in operation latch holders are not necessary so that another source of soiling and defects will be eliminated. In processes of knitting patterned pile fabrics non selected needles or needles which have already picked up pile fibres can be moved substantially beneath the tuck or feeding position so that even during the succeeding selecting and combing-in operations the selected needles must not be raised higher than to the tuck position. This will enable the knitting-in of pile fibres as tuck loops.

Figure 2:
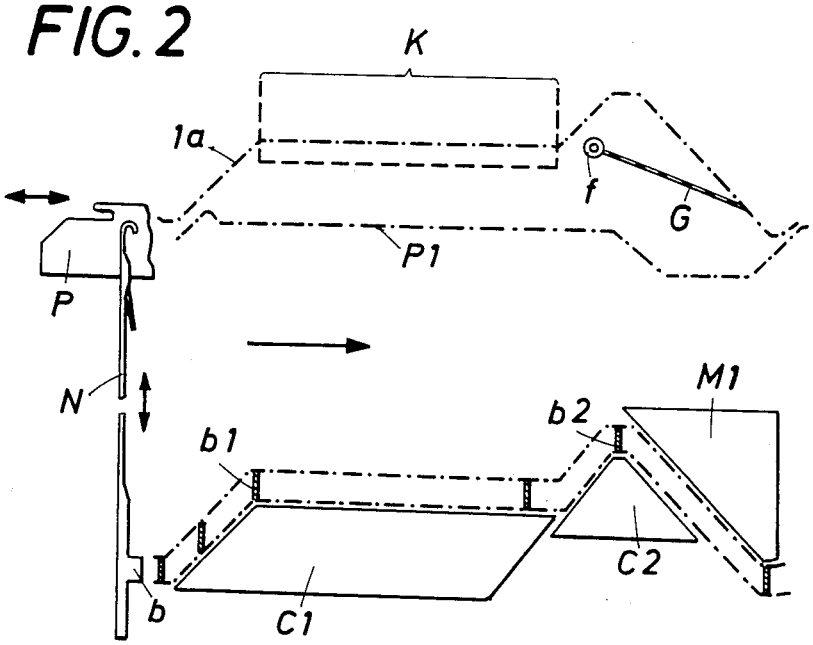
Figure 3:
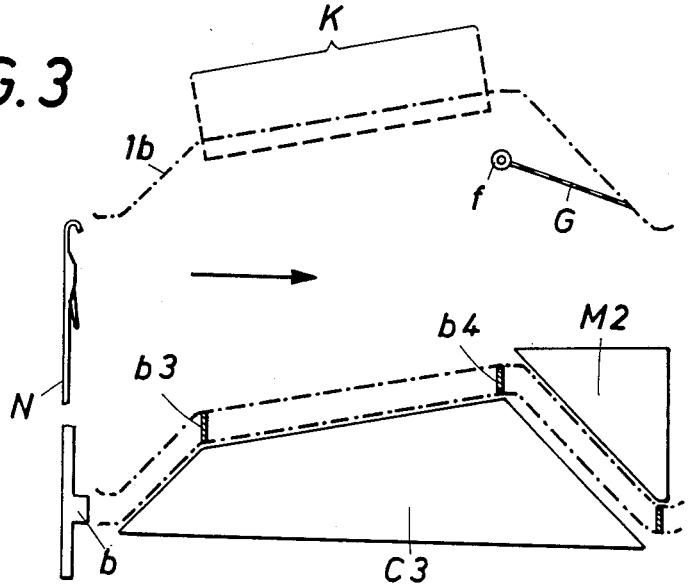
Figure 4:
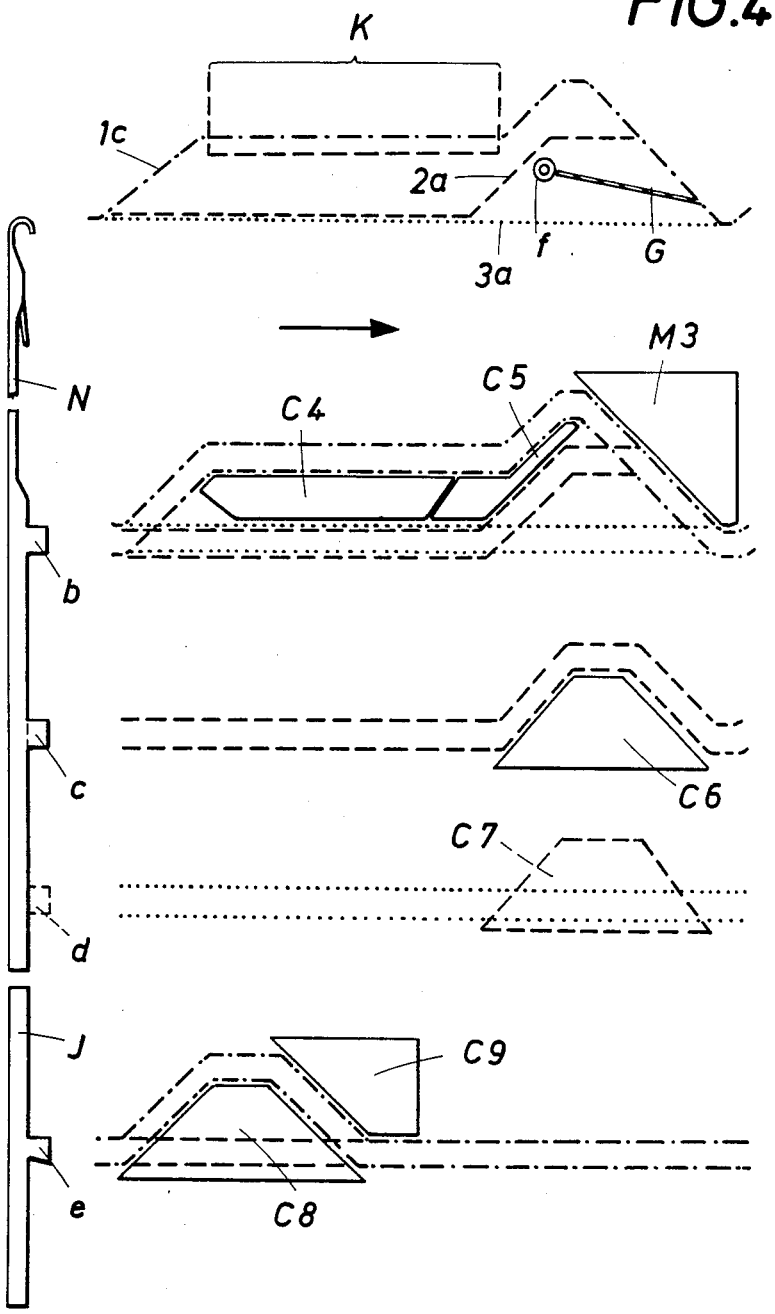
Figure 5:
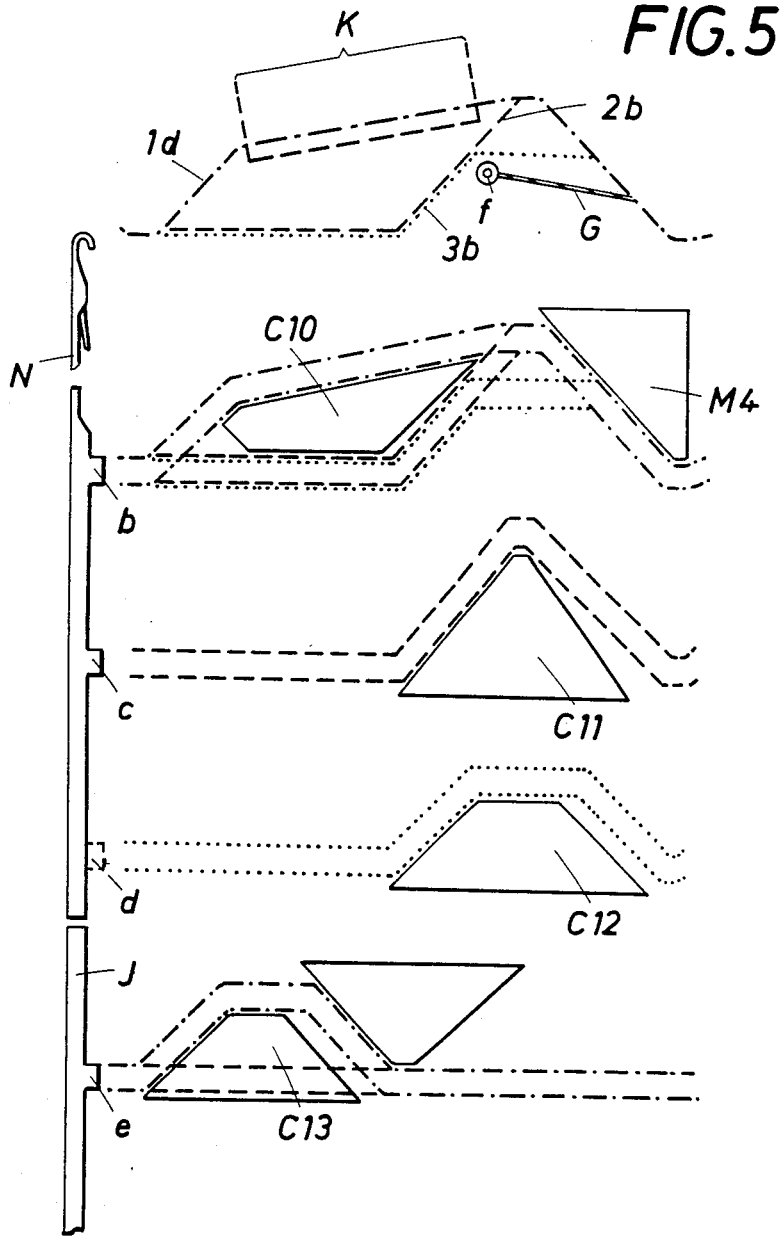
Figure 6:
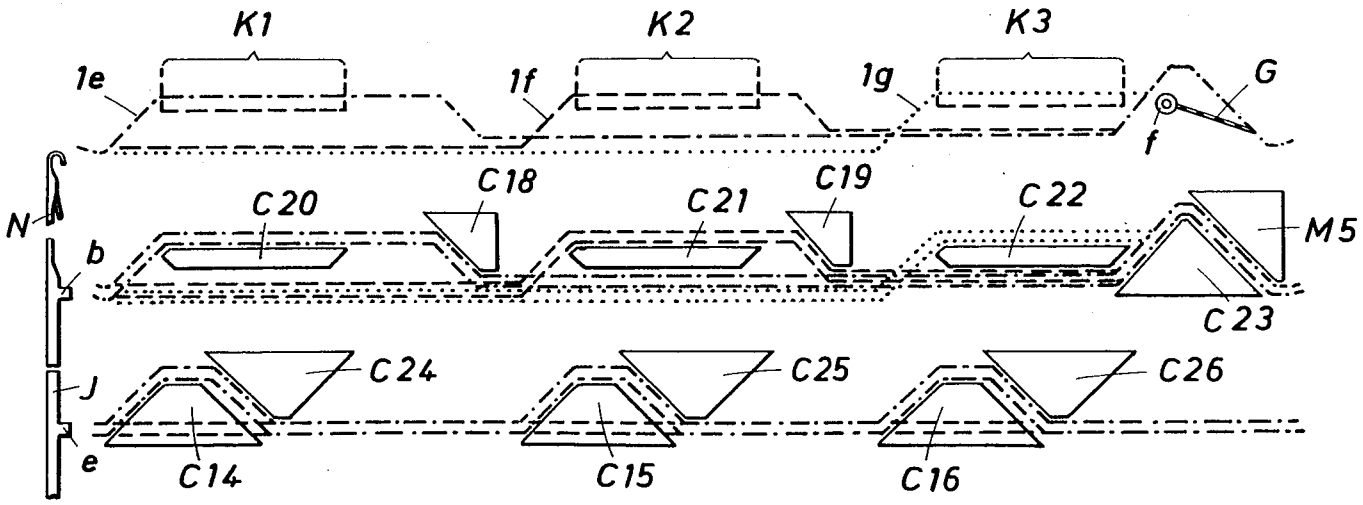
Figure 7:
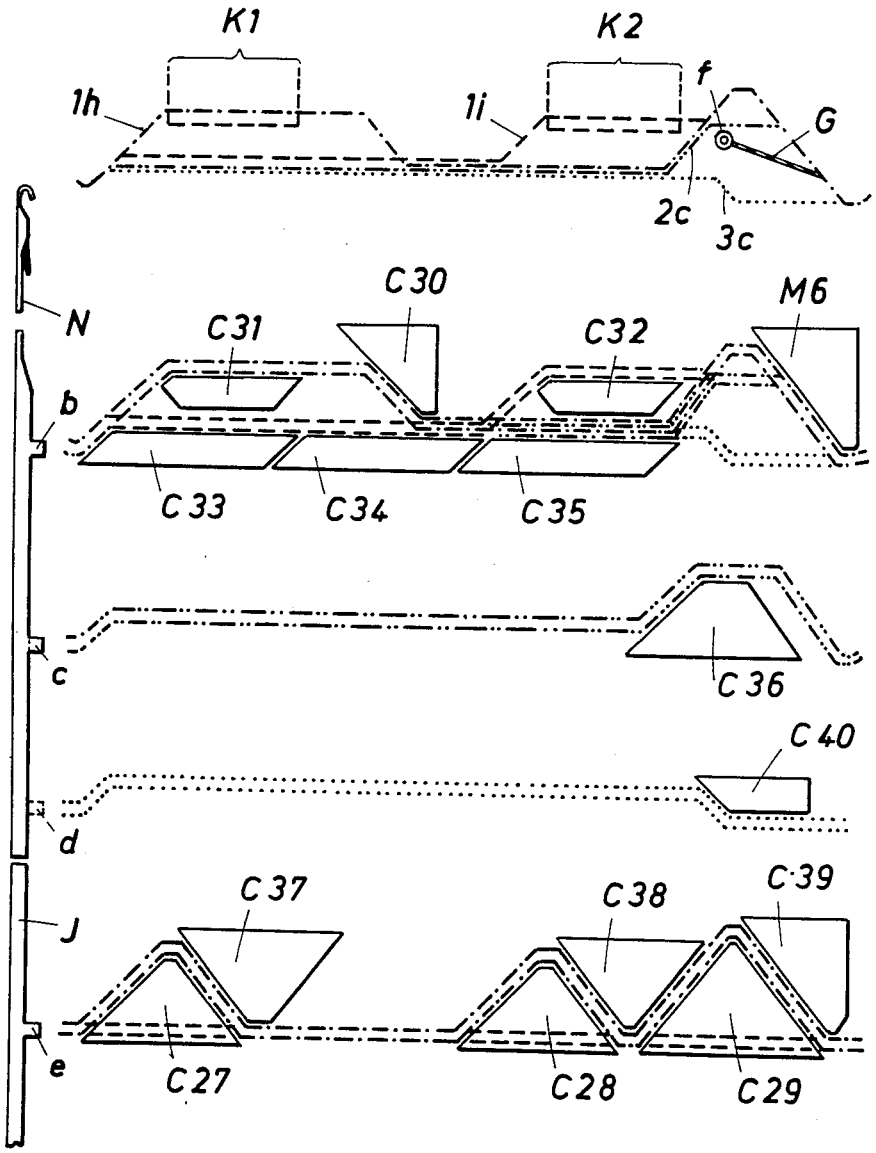
Figure 8:
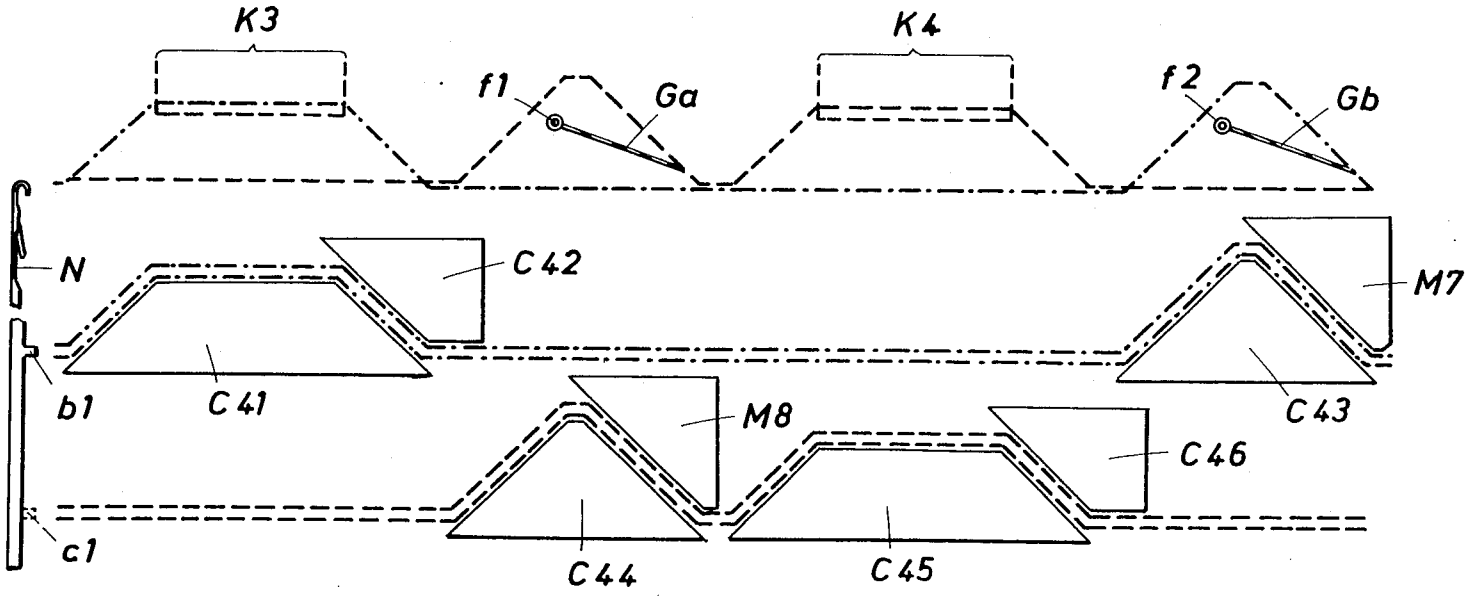
Figure 9:
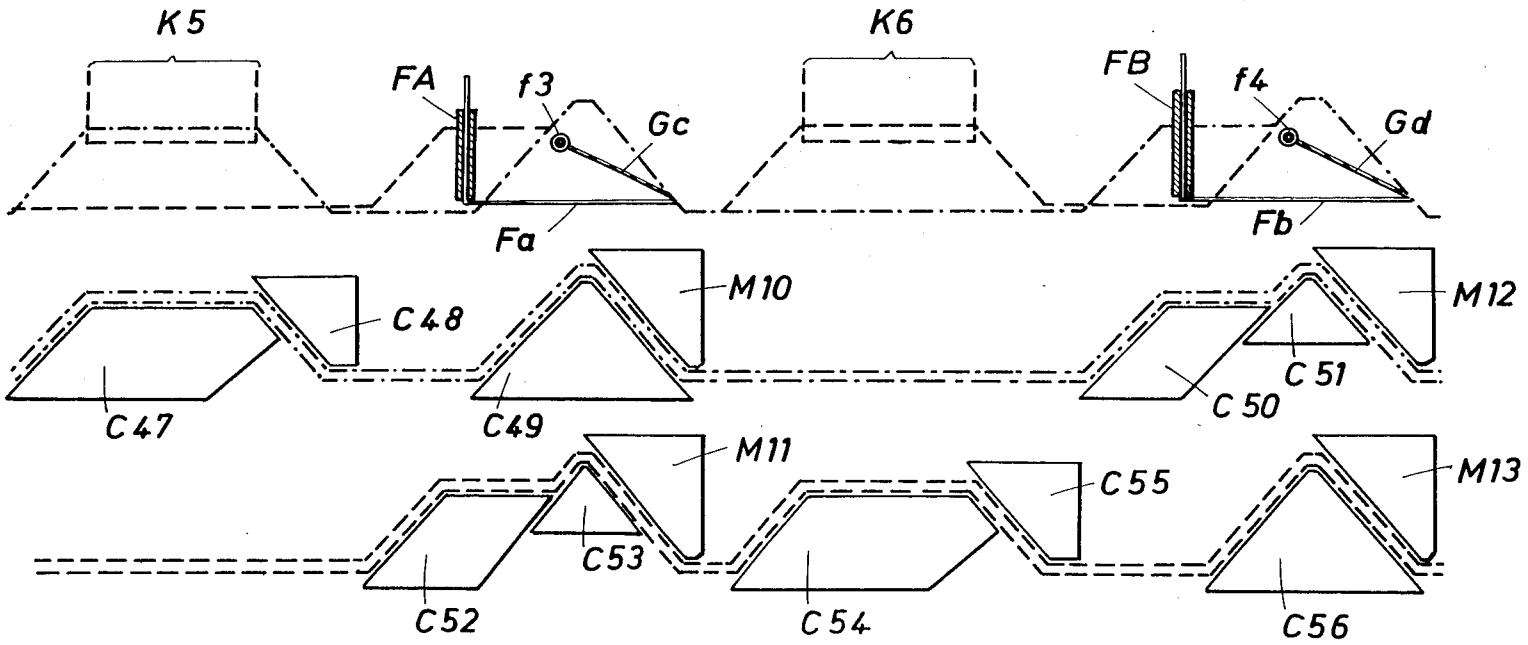
Figure 13:
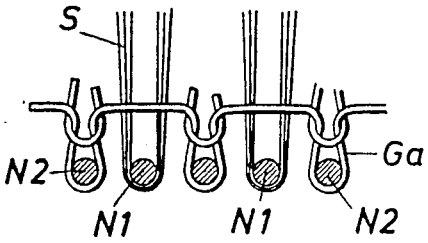
Figure 14:
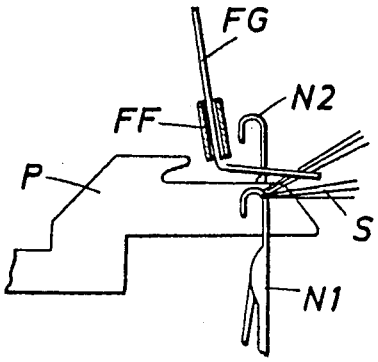
Figure 15:
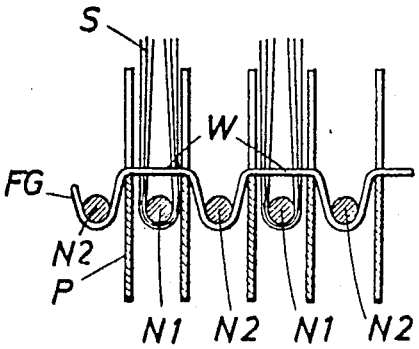
Figure 16:
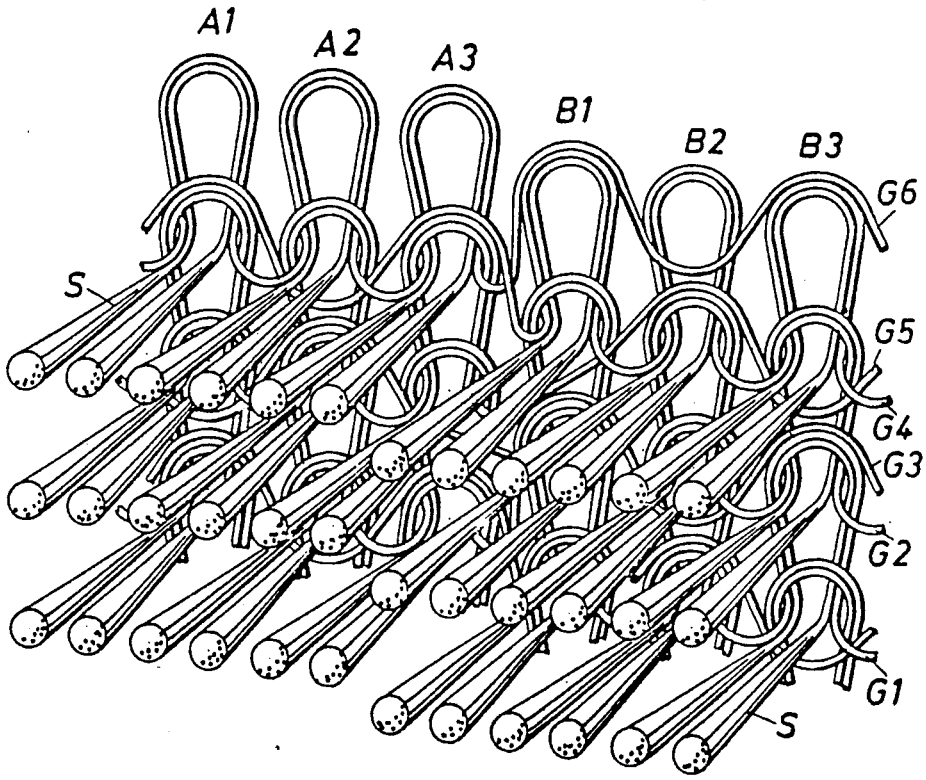
Figure 17:
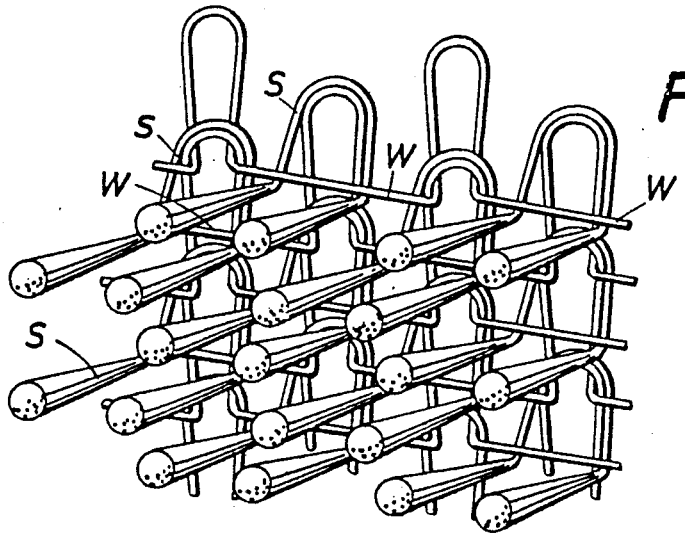
Figure 18:
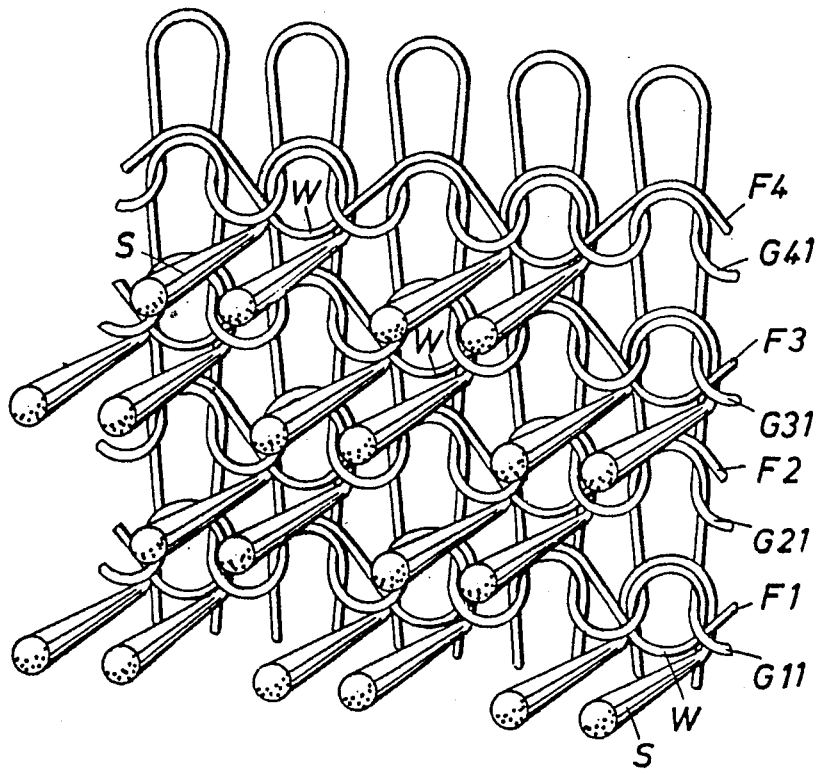

The invention will now be explained more in detail with reference to a plurality of illustrative embodiments shown in the drawings, in which FIG. 1 illustrates the position of needles and combing-in pile fibres according to the invention, FIGS. 2 and 3 are diagrammatic views of a system producing a plain pile fabric, FIGS. 4 and 5 are diagrammatic views of a system knitting patterned pile fabrics, FIGS. 6 and 7 illustrate other methods according to the invention for producing patterned pile fabrics, FIGS. 8 and 9 diagrammatically illustrate methods for knitting in pile fibres retained by successive knitted sinker loops, FIGS. 10–12 and 14 show needle positions according to one of the above methods, FIGS. 13 and 15 are views to illustrate methods to keep down previously combed-in pile fibres, when these needles are raised again, FIG. 16 illustrates a fabric knitted according to the method of FIG. 4, FIG. 17 illustrates a fabric knitted according to the method of FIG. 8, FIG. 18 illustrates a fabric knitted according to the method of FIG. 9.

In FIG. 1 the knitting instruments are illustrated in a position according to the invention. Movable latch needles N are arranged in slots of the cylinder Z and are actuated by the cylinder cams ZS, mounted in a cylinder cam ring ZT. Movable sinkers P are arranged in slots of a sinker ring R and will be projected radially by cams PS, mounted in a sinker cam plate PT. While the shown sinker P is in an inactive inward position, the needle N is raised to tuck position. In such a position the needle hook h enters the carding cloth k which covers the combing-in wheel K of each card. The hook h of the needle N is opened exclusively by the previously knitted stitch m, which forces the latch open. The fabric rests on the knock-over edge A of the sinker P and is prevented from being raised with the needle N by the neb of the sinker.

FIG. 2 illustrates diagrammatically a knitting process according to the invention. The rotating cylinder moves the needles from the left to the right. In all other figures, the needles also pass in the same direction. At the start of combing-in the butt b of the needle N receiving the combed-in pile fibres comes in contact with raising cam C1 and will be raised to the tuck position. A butt raised to tuck position is indicated with b1. At this level, the tips of the latches of the needles are positioned below the knock-over or knitting edges of the sinkers, as indicated by line 1*a*, come in contact with the combing-in wheel K of a card and will pick up pile fibres to comb-in the pile fibres at this level. The needles remain at this level during the complete combing-in process. When the needles have passed the combing-in wheel K they will be raised by cam C2 into the clearing position, indicated by butt b2. Simultaneously the feeder f supplies a base thread G to the needles which are successively retracted by the stitch cam M1 to the knock-over position, knitting a base fabric in which the needle loops interlock the pile fibres, previously picked up by the needle hooks. The sinkers P are retracted when the base thread G is fed, so that the nebs cannot influence the looping process and are projected inwardly after the needles are retracted. The movement of the sinkers is indicated in the illustration of FIG. 2 by line P1. Because the latches of the needles are cleared after feeding the base-thread, latch-openers are not necessary.

FIG. 3 illustrates another knitting process to produce a plain pile fabric. Butts b of the needles N contact raising cam C3 and will be raised in tuck position, indicated by butt b3. While the needles are passing the combing-in wheel K (line 1*b*) the cam C3 raises the needles simultaneously to the clearing position (butt b4), so that the needles can be retracted by the stitch-cam M2 immediately when they have passed the combing-in wheel K of the card and a base-thread G is fed by the feeder f. When the needles and their hooks are raised during the passage of the carding-wheel K the cards or at least the carding-wheel K must be arranged inclined according to the shape of cam C3. With this method the length of the system is decreased.

For producing patterned pile fabrics only selected needles will be raised to pick up pile fibres with their hooks from the combing-in wheel. Different methods for selecting the needles are well known. It can be done by a pattern wheel (described in U.S. Pat. Nos. 2,127,224 and 2,269,288), by pattern drums (described in U.S. Pat. No. 3,874,197) or by electronic means (described in U.S. Pat. No. 4,307,586). Because the method of selecting the needles is irrelevant to the invention, reference is made to the detailed description in the mentioned patents.

FIG. 4 illustrates diagrammatically a method to produce a patterned pile fabric. In this embodiment, different butts are arranged on each needle shank. All needles have a butt b. In a preferred embodiment needles with butts b and c will alternate with needles with butts b and d. Also needles only with a butt b can alternate with one or both sets of the described needles. The knitting process starts with raising selector-jacks J when their butts e are engaged by selector raising cam C8. While butts e of non-selected jacks are inactive they will not be engaged by the cam C8. Selector-jacks J which are raised by the cam C8 also raise their corresponding selected needles N to the tuck position. In this position the selected needles pass the dividing cam C4 with butt b and the hooks of selected needles, indicated by line 1*c*, will pass the combing-wheel K. Non-selected needles remain in miss-position. The raised selector jacks are retracted by cam C9 and will be prepared for the subsequent selection. Since the selected needles have passed the combing-in wheel K a raising cam C5 raises the selected needles to the clearing position. To prevent longer floats from the base thread in accordance with the pattern non-selected needles N with an additional butt c are raised by cam C6, indicated by line 2*a*, to the tuck position before a base thread G is fed by feeder f. Cam C7 is removed, needles N with an additional butt d or only with butt b remain in miss position (line 3*a*). The arrangement of the cams C6 and C7 can be changed in the subsequent feeders or systems in which according to the pattern other selected or non-selected needles will be raised according to the description before. During a desired knitting cycle each needle knits a stitch.

It is also to be understood that cams for raising the butts c and d can project their needles to the clearing position. Therefore, a person skilled in the art can determine the best cam arrangement in accordance with the desired fabric.

A fabric based on a method described in accordance with FIG. 4 is shown in FIG. 16. In the wales A1, A2 and A3 the base threads G2, G4 and G6 are knitted to a base fabric in which the needle loops consist of a first pile material. In the wales B1, B2 and B3 the same base threads are alternatively knitted to tuck and welt stitches. Wales B1, B2 and B3 are knitted from base threads G1, G3 and G5 and a second pile material. The base threads G1, G3 and G5 are alternatively knitted to tuck and welt stitches in the wales A1, A2 and A3. In this way a limitation of the patterning according to the structure of the fabric is prevented.

If non-selected needles after passing the combing-in wheel are raised to the clearing position base threads are knitted so that the production rate is increased.

Such an example is illustrated in FIG. 5. Selector-jacks J which are in an active position are raised by their butts e by raising cam C13 so that the corresponding needles N will be raised to the tuck position. The hooks of these needles (line 1*d*) pass the combing-in wheel K. Simultaneously cam C10 raises the selected needles to the clearing position by their butts b. Non-selected needles with a butt c are also raised by the cam C11 to the clearing position, but remain at a distance from the combing-in wheel K so that the hooks of these needles are prevented from picking up any pile fibres (line 2*b*). Non-selected needles with a butt d are raised by cam C12 to the tuck position (line 3*b*). If only needles with a butt b are mounted in the cylinder all needles are raised and will engage the base thread G fed by the feeder f. All needles are retracted then to the knock-over position by cam M4. For raising non-selected needles before feeding the base thread G other shaped cams, to which reference has been made in connection with FIG. 4, can be used.

Figure 10:
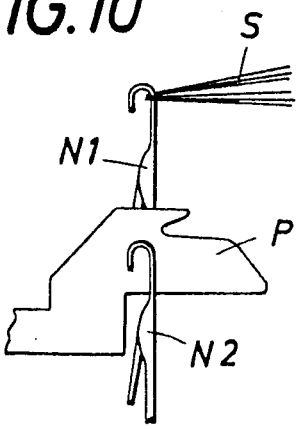
Figure 11:
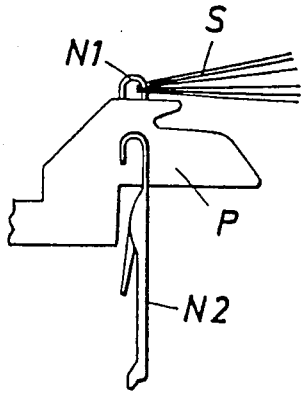
Figure 12:
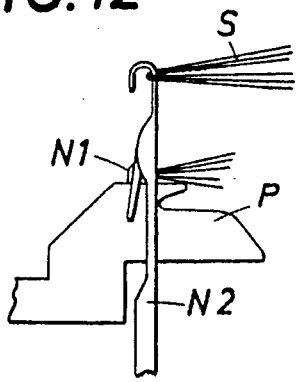

The portions of the base threads which are knitted to a lay-in structure reduce the elasticity of the fabric. For many end-uses this is a desired effect. But if an extraordinary elasticity and a high pile density is required, the different pile fibres must be knitted simultaneously with a base thread to a complete course. A method to knit such a fabric in accordance with the invention is illustrated in FIG. 6. According to the illustration of FIG. 6 three different pile materials should be knitted into a course. These materials are delivered to the needle hooks by three successively arranged combing-in wheels K1, K2 and K3 representing three systems. At the first system a first set of needles indicated by line 1*e* are raised by the corresponding selector jacks J and cam C14. The position of the needles when they have passed the combing-in wheel K1 is shown in FIG. 10. Needles N1 have picked up pile fibres S while all non-selected needles N2 remain in miss-position. After the cam C18 has retracted the selected needles N1 to an intermediate position, shown in FIG. 11, the needles enter the second system. In the intermediate position the needle hooks are positioned above the sinker nebs, preventing the pile fibres from contacting the base-fabric or the successive combing-in wheels. A second set of needles indicated by line 1*f* is selected and raised (FIG. 12) to the tuck position by cam C15 of the patterning device and will pass the second combing-in wheel K2, controlled by cam C21. Successively the raised needles of the second set are retracted from cam C19 to the intermediate position described before. In the third system a third set of needles is selected by a patterning device and is raised to the tuck position by corresponding selector jacks which are also raised by cam C16. After the third set of the needles have passed combing-in wheel K3 a raising cam C23 raises all needles to clearing position and stitch cam M5 will retract the needles to the knock-over position when a base thread G is fed from a feeder f. The sinkers are usually retracted outwardly on the third system when the base yarn G is fed and projected inwardly to the axis of the cylinder simultaneously with the knock-over procedure.

It is also possible to raise all needles at the first system to the intermediate position in which the selected needles will be retracted after passing one of the combing-in wheels K1 or K2. A combination of the methods illustrated and described in accordance with FIGS. 4 and 6 is shown in FIG. 7. Needles N with butts b and c alternate with needles with butts b and d. A base thread G should be knitted from a first group of selected needles, subdivided into two different sets picking up different pile fibres each. Subsequently knitted base threads will add to a complete course. The process starts with raising all needles to an intermediate position described before by cam C33 and controls this position by cams C34 and C35. A first set of needles is selected by corresponding selector jacks J and raised from cam C27 to the tuck position (line 1*h*). They pass a first combing-in wheel K1 controlled in this position by cam C31 and are retracted subsequently from cam C30. Successively the second set of needles is selected and raised by corresponding selector jacks J from cam C28. While these needles pass the combing-in wheel K2 the selector jacks are retracted from cam C38 and reselected. Both sets of previously selected selector jacks will be in an active position. Therefore the cam C29 will raise all jacks and corresponding needles selected before to pick up one of the pile materials to the clearing position. Non-selected needles with a butt c are raised simultaneously by cam C36 to the tuck position while cam C40 will retract all non-selected needles with a butt d to the miss-position. On the successive system or systems a second group of needles knits stitches alternating with the stitches knitted previously, so that a complete course will be made. If one group of systems is knitting only base threads in accordance with the described methods in FIGS. 4, 5 or 7 the areas of the fabric without pile fibres are made denser by the lay-in portions of the base threads knitted in the other areas of the fabric.

As described before persons skilled in the art will be able to introduce novel knitting-structures in pile fabric in accordance with the invention. Another advantage of the invention comprises knitting-in the pile fibres as tuck loops and to retain them by the sinker loops of the fabric in a simple way.

FIG. 8 illustrates one of the prefered methods mentioned before. In the cylinder needles with butts b1 alternate with needles with butts c1. Needles with butts b1 are raised to the tuck position by cam C41 and their hooks pass a combing-in wheel K3 while needles with butts c1 remain in missposition (FIG. 10). After combing-in pile fibres needles with butts b1 are retracted by cam C42. The sinkers are also retracted outwards so that the hooks pull the pile fibres to the base fabric. The sinkers will be projected inwardly and needles with butts c1 are raised by cam C44 in clearing position, needles with butts b1 remain in miss-position. Feeder f1 supplies a base thread Ga and the needles are retracted by stitch cam M8.

As shown in FIG. 15 needles N1 (with butts b1) pick up the pile fibres S after the needles N2 have knitted stitches from the base thread Ga. Welt floats W of the base thread Ga covers the pile fibres S and prevent them from projecting with the needles when the needles with butts c1 are raised by cam C45 to the tuck position to pick up pile fibres from the combing-in wheel K4. When needles with butts c1 are retracted by cam C46, cam C43 raises needles with butts b1 to the clearing position, engage base thread Gb fed from feeder f2 and are retracted from stitch cam M7, so that these needles have knit a stitch, too. The missing base thread Gb covers the pile fibres picked up from needles with butts c1 and prevents them from being raised the needles with butts b1 when subsequently raised again to pick up pile fibres.

With the above described method pile fabrics with a high pile density can be produced if desired. While pile fibres are cleared from the hook before the base thread is fed the quantity of pile fibres according to each stitch can be increased. The pile fibres are not shown on the stitch side of the fabric, accordingly a plain stitch side exclusively knitted from base threads results.

A fabric knitted in accordance with the described method of FIG. 8 is shown in FIG. 17. Each base thread is knitted in alternative wales, the stitches are connected by welt floats W which integrate the pile fibres S to the fabric.

Another method to integrate the pile fibres into the fabric without knitting them into stitches is illustrated in FIG. 9. As described before, needles with butts b1 alternate with needles with butts c1. Needles with butts b1 are raised for picking up pile fibres by carding wheel K5 from cam C47 and are retracted by cam C48. Subsequently needles with butts c1 are raised by cam C52 to the tuck position and the sinkers are retracted to supply a lay-in thread Fa by a feeder FA. In FIG. 14 the positions of sinker P, previously raised needles N1 picking up pile fibres, needles N2 raised last, feeder FF and lay-in thread FG are illustrated. When the sinkers are projected radially to the center of the cylinder, the lay-in thread is looped and welt floats are formed where the needles with butts b1 remain in miss-position. Subsequently these needles with butts b1 are raised to the clearing position by cam 49 and the needles with butts c1 are raised by cam C53 to the same level. The welts of the lay-in thread prevent the previously combed-in pile fibres from projecting with the needles so that they can clear the latches exactly. When feeder f3 has supplied base thread Gc all needles are retracted to the knock-over position by stitch cams M10 and M11. The next course is produced in the same way the two needle sets being actuated reciprocably. Needles with butts b1 are raised to the tuck position by cam C54, pick pile fibres from combing-in wheel K6 and are retracted by cam C55. Subsequently needles with butts b1 are raised by cam C50 for tucking, the sinkers are retracted for feeding a lay-in thread Fb by feeder FB and after projecting the sinkers inwardly all needles are raised by cams C51 and C52 to the clearing position. A base thread Gd is fed from feeder f4 and all needles are retracted to the knock-over position by the stitch-cams M12 and M13.

A fabric according to the above described method is shown in FIG. 18. Base threads G11, G21, G31 and G41 are formed to courses incorporating lay-in threads F1, F2, F3 and F4 and integrated by the welts with the pile fibres S cooperating with the sinker-loops formed from the base threads.

It will be understood that the embodiments illustrated and described before are practicable also in combinations with each other or with other known methods.

What is claimed is:

1. A method for producing a plain or patterned high-pile or sliver-knit fabric on a circular knitting machine comprising a cylinder carrying latch needles having hooks, a sinker ring carrying sinkers having knock-over or knitting edges, carding means associated therewith and arranged for combing-in pile fibers to the needle hooks, cam arrangements for actuating the needles and the sinkers cooperatively with the associated carding means, and feeding means for delivering base threads to the needles for knitting a base fabric therefrom incorporating said pile fibers, which comprises the improvement of raising the needles receiving the combed-in pile fibres at the start of combing-in to a level at which the tips of the latches of the raised needles are positioned below the knock-over or knitting edges of the sinkers and the stitches of a previously knitted course of the fabric remain on said latches, and combing-in the pile fibers at said level.

2. The method of claim 1, wherein said needles remain at said level during the complete combing-in process.

3. The method of claim 1, wherein selected ones of the needles are raised to said level.

4. The method of claim 3, wherein selected needles receive the pile fibers alternatively in successive feeding operations prior to the feeding of the base thread.

5. The method of claim 1, wherein said needles are raised to a clearing position subsequently to being raised to said level in which they remain during the combing-in process.

6. The method of claim 1, wherein said needles are retracted subsequent to the combing-in process to miss the subsequently fed base thread, and are raised subsequently and prior to feeding a successive one of the base threads for knitting stitches therefrom.

7. The method of claim 1, wherein the needles not predetermined to receive pile fibres are additionally selected to engage the base thread.

* * * * *